United States Patent [19]

Hara et al.

[11] Patent Number: 4,498,432

[45] Date of Patent: Feb. 12, 1985

[54] VARIABLE VALVE TIMING ARRANGEMENT FOR AN INTERNAL COMBUSTION ENGINE OR THE LIKE

[75] Inventors: Seinosuke Hara; Shunichi Aoyama; Kazuyuki Miisho, all of Yokosuka, Japan

[73] Assignee: Nissan Motor Company, Limited, Japan

[21] Appl. No.: 388,705

[22] Filed: Jun. 15, 1982

[30] Foreign Application Priority Data

Jun. 16, 1981 [JP] Japan ..... 56-87396[U]
Jun. 30, 1981 [JP] Japan ..... 56-98125[U]

[51] Int. Cl.[3] ..... F01L 1/34; F02D 13/02

[52] U.S. Cl. ..... 123/90.16; 123/90.43; 123/90.45; 123/90.52; 123/90.55; 123/90.39

[58] Field of Search ..... 123/90.44, 90.45, 90.46, 123/90.48, 90.52, 90.55, 90.39, 90.41, 90.43, 90.27, 90.47, 90.15, 90.16

[56] References Cited

U.S. PATENT DOCUMENTS

| | | | |
|---|---|---|---|
| 1,691,991 | 11/1928 | Puckett | 123/90.44 |
| 1,701,563 | 2/1929 | Griswold | 123/90.47 |
| 2,829,540 | 4/1958 | Niemeyer | 123/90.47 |
| 3,413,965 | 12/1968 | Gavasso | 123/90.16 |
| 4,167,931 | 9/1979 | Iizuka | 123/90.46 |
| 4,220,122 | 9/1980 | Aoyama | 123/90.46 |
| 4,380,219 | 4/1983 | Walsh | 123/90.41 |
| 4,438,736 | 2/1984 | Hara et al. | 123/90.16 |

FOREIGN PATENT DOCUMENTS

| | | | |
|---|---|---|---|
| 209739 | 5/1909 | Fed. Rep. of Germany . | |
| 54-0121314 | 9/1979 | Japan | 123/90.55 |
| 57-0188717 | 11/1982 | Japan | 123/90.15 |

*Primary Examiner*—Craig R. Feinberg
*Assistant Examiner*—David A. Okonsky
*Attorney, Agent, or Firm*—Lowe, King, Price & Becker

[57] ABSTRACT

A reaction member located above an angled rocker arm induces the latter to pivot once a telescopically extendible hydraulic tappet, under the influence of a cam, has lifted the rocker arm sufficiently to engage an apex thereof against the reaction member. The tappet includes a piston which defines therein a variable volume chamber into which hydraulic fluid may be readily introduced via a solenoid control valve, but only slowly discharged. The degree of extension of the tappet controls the valve lift induced by the rocker arm.

19 Claims, 16 Drawing Figures

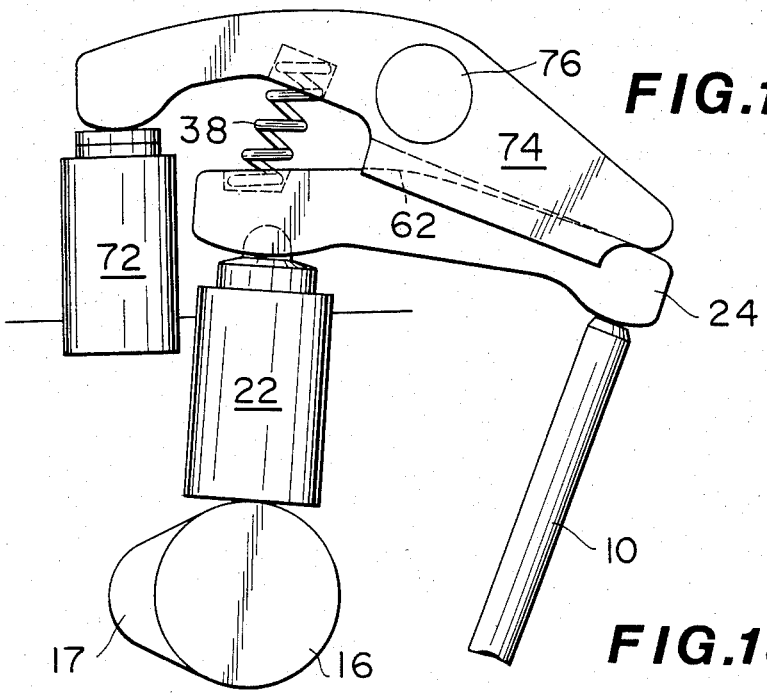
FIG.12
FIG.13
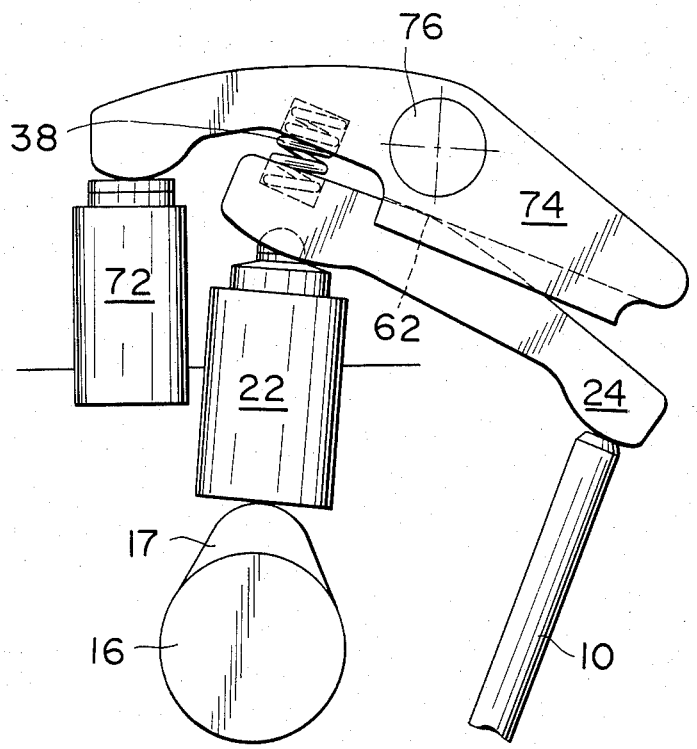

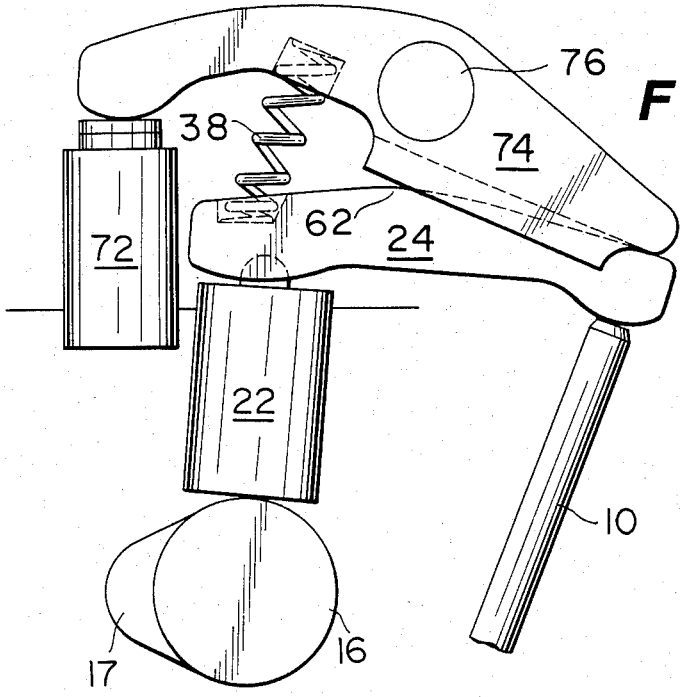
FIG.14
FIG.15
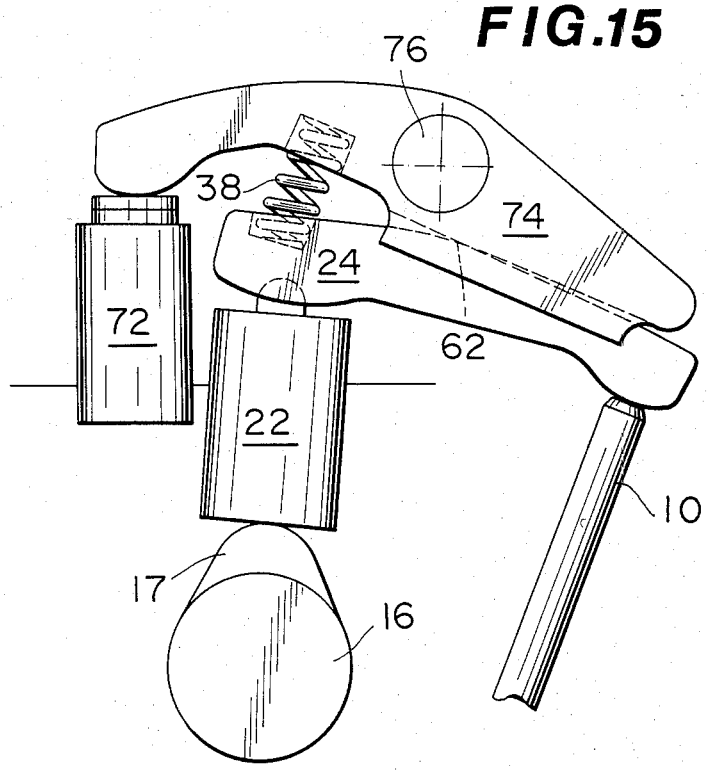

VARIABLE VALVE TIMING ARRANGEMENT FOR AN INTERNAL COMBUSTION ENGINE OR THE LIKE

BACKGROUND OF THE INVENTION

1. Field of the Invention

The present invention relates generally to a valve train for an internal combustion engine or the like and more specifically to a variable valve timing arrangement therefor.

2. Description of the Prior Art

In a known arrangement such as shown in FIG. 1 of the present application, it has been proposed to operate a poppet valve, such as an inlet or exhaust valve of an internal combustion engine, via a rocker arm 1 which engages a cam 2 at one end and which is pivotally mounted on top of the stem 3 of the valve 4 at the other end. The upper surface of the rocker arm 1 is contoured and adapted to abut a lever 5. The point of abutment with the lever 5 defines the pivot or fulcrum point of the rocker arm. With this arrangement as the cam 2 rotates the rocker arm 1 is cammed to pivot about the fulcrum point defined by the aforementioned contact and induce the valve 4 to reciprocate. To vary the timing and degree of lift the valve 4, a second cam 6 is provided and adapted to abut the lever 5. The second cam 6 is selectively rotated by a suitable hydraulic motor or the like (not shown). Thus, if the second cam 6 is rotated in a direction to urge the lever 5 to rotate counter-clockwise (viz., downwardly as seen in the drawings) the degree of valve lift and the duration for which the valve is open will be increased. Rotation of the cam which allows the lever to point in the clockwise direction (as seen in the drawings) reduces the valve lift and the duration for which the valve is open.

However, this arrangement has suffered from the drawbacks that the provision of the cam and lever arrangement above the rocker arm increases the overall height of the engine and, as the lever/cam arrangement does not permit ready adjustment of the clearance between the rocker arm and the top of the valve stem, a rather large clearance must be provided to allow for thermal expansion, wear etc. This clearance unavoidably leads to the generation of so called "tappet noise", vibration and also tends to deteriorate the valve timing itself. A further drawback comes in that, in the case the above disclosed arrangement is applied to an engine having four or more cylinders, as the cams are usually disposed on the same common cam shaft for the purpose of simplicity, the shaft is constantly subjected to reaction forces produced by the valve springs acting thereon through the rocker arms and levers which forces tends to rotate the shaft back against the bias applied by the servo. These forces tend to peak during engine operation as each valve lift reaches its zenith and the fulcrum point defined between each lever and rocker arm moves in the direction of the cam. Thus, in the case wherein a single servo is connected to one end of this cam shaft, it must be able to produce sufficient power to both maintain the shaft in any given desired position against this reaction force as well as overcoming the friction generated between the bearings etc., of the shaft by the reaction force when it is desired to vary the valve timing.

This latter drawback is particularly manifest in four cylinder engines wherein a valve is always being lifted.

One method for overcomming this problem would be to provide a servo and cam shaft for each valve, however this would lead to a prohibitively complex arrangement which would be both heavy and difficult to precisely control. For a complete disclosure of the above described arrangement reference is made to U.S. Pat. No. 3,413,965 issued on Dec. 3, 1968 in the name of J. M. Gavasso.

SUMMARY OF THE INVENTION

The present invention features an arrangement wherein a telescopically extendible hydraulic tappet pivotally supports one end of an angled rocker arm and wherein a reaction member located above the rocker arm induces the latter to pivot once the tappet, under the influence of a cam has lifted the rocker arm sufficiently to engage an apex thereof against the reaction member. The tappet includes a piston which defines a variable volume chamber therein into which hydraulic fluid may be readily introduced but only slowly discharged. An electronically controlled valve controls the pressure fed to the chamber in accordance with a plurality of variables. By varying the pressure in the chamber and thus the degree of extension of the tappet, the degree of valve lift induced by the rocker arm can be varied.

BRIEF DESCRIPTION OF THE DRAWINGS

The features and advantages of the arrangement of the present invention will become more clearly appreciated from the following description taken in conjunction with the accompanying drawings in which:

FIGS. 12 and 13 are schematic elevations showing the fourth embodiment with the hydraulic tappet thereof set for maximum valve lift; and FIGS. 14 and 15 are views similar to those of FIGS. 12 and 13 but showing the hydraulic tappet set for minimum valve lift.

DETAILED DESCRIPTION OF THE PREFERRED EMBODIMENTS

Figure 1:
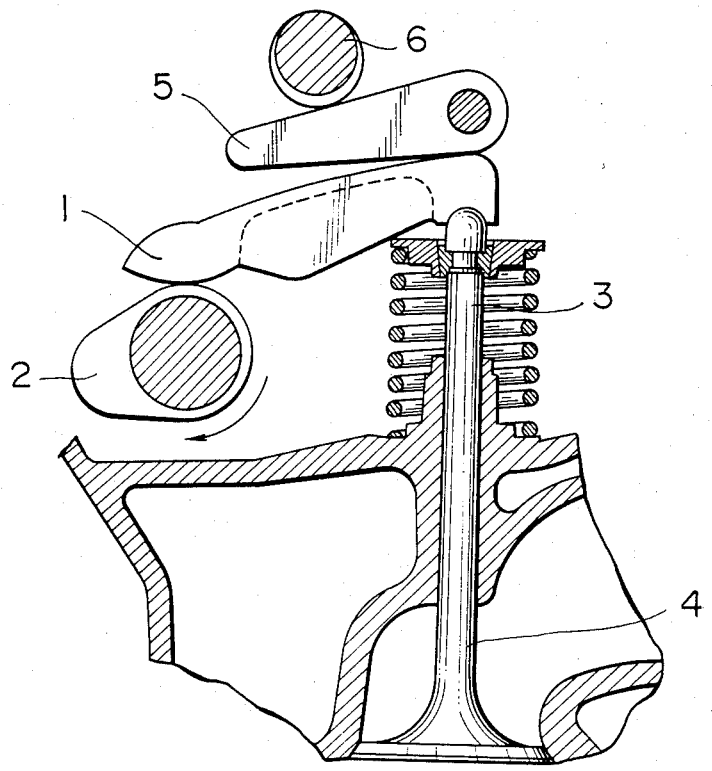
FIG.1 PRIOR ART
FIG. 1 is a partially sectioned view of the prior art arrangement discussed in the opening paragraphs of the instant disclosure.
Figure 2:
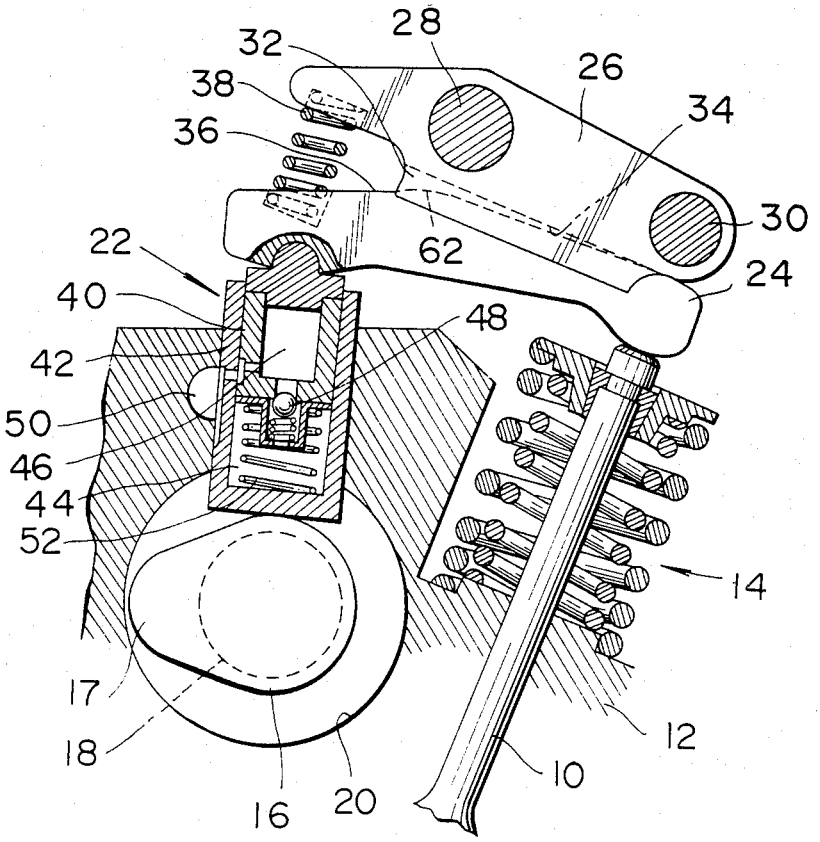
FIG. 2 is an elevation (partially in section) of a first embodiment of the present invention.

Turning to the drawings and in particular FIG. 2, a first embodiment of the present invention is shown. In this arrangement a poppet valve 10, which may be either an inlet or an exhaust valve, is operatively disposed in an internal combustion engine cylinder head 12. This valve 10 is biased to a closed position under the influence of a nest of coil springs 14. A cam 16 having a lobe 17 is mounted on an overhead cam shaft 18 disposed in a suitable elongate bore 20. A telescopic hydraulic tappet unit 22 is reciprocatively disposed in the cylinder head so as to contact the cam at one end thereof and pivotally support an angled rocker arm 24 at the other end thereof. A reaction member 26 fixedly mounted in place on two parallel shafts 28, 30 is formed with an elongate slot 32 in which an essentially flat surface 34 is defined and against which the upper surface 36 of the rocker arm 24 is engageable. A spring 38 is disposed between the end of the reaction member 26 and the end of the rocker arm 24 which is pivotally mounted on a dome-like projection formed at the top of the telesopic tappet 22.

The telescopic tappet unit 22 includes a piston 40 reciprocatively disposed in a hollow cylinder 42 to define a closed variable volume chamber 44 therein. The piston 40 itself is formed with a fixed volume chamber 46 which communicates with the variable volume chamber 44 through a one-way check valve 48 (in this case a ball valve). The fixed volume chamber 46 is adapted to constantly communicate with an oil gallery 50 through radial bores and intervening recesses. With this arrangement the hydraulic pressure prevailing in the oil gallery 50 is transmitted via the fixed volume chamber 46 and the one-way check valve 48 to the variable volume chamber 44. Disposed within the chamber 44 is a spring 52 which biases the piston 40 to project out of the cylinder 42.

Figure 3:
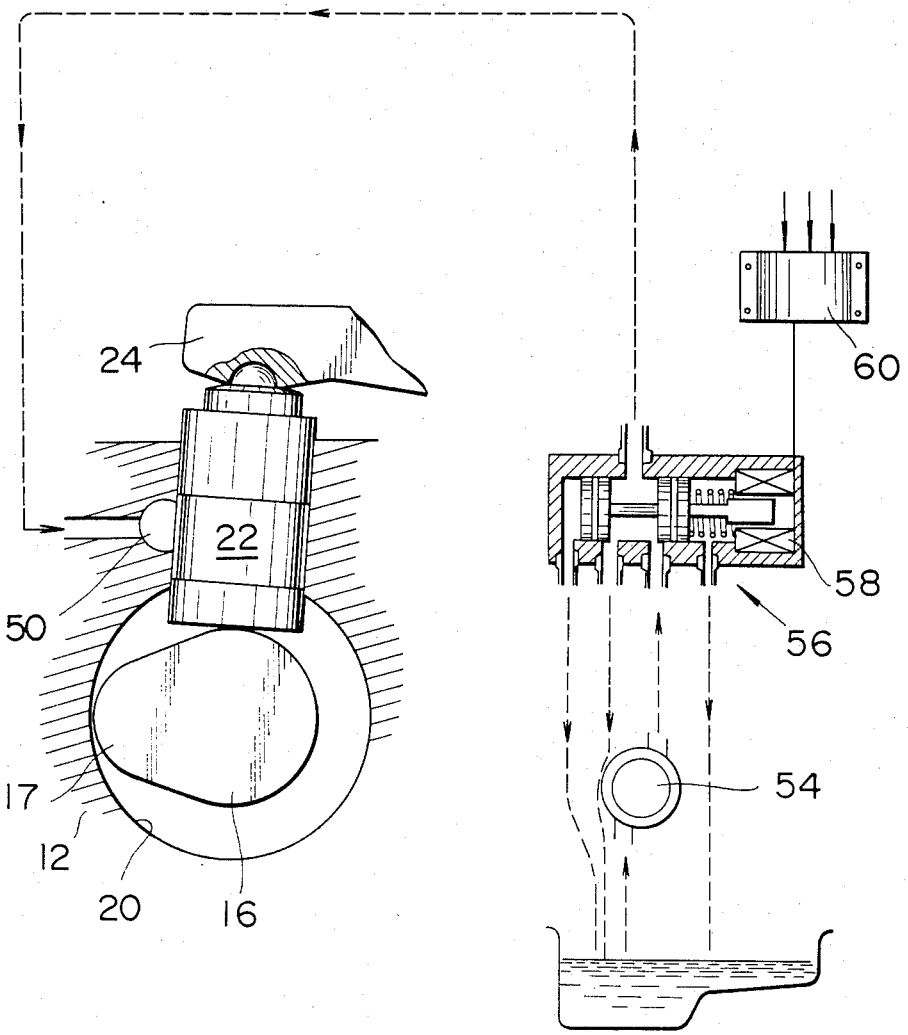
FIG. 3 is a schematic diagram showing the arrangement of FIG. 2 with a suitable hydraulic control circuit for controlling the degree of pressurization and subsequent extension of a telescopic hydraulic tappet which forms a vital part of the invention.

FIG. 3 shows an example of a hydraulic control circuit which may be used to control the fluid pressure prevailing in the oil gallery. In this arrangement an oil pump 54 supplies hydraulic fluid under pressure to an electromagnetic valve 56 which modulates the output of the pump 54 in accordance with a control signal fed to the solenoid 58 thereof from a control circuit 60. The control circuit receives and computes various inputs indicating pararameters such as engine speed, intake air volume, and engine coolant temperature and issues an energizing signal via which the valve is energized. The latter mentioned parameter is of importance to allow for the temperature change of the fluid fed to the telescopic tappet 22 and prevent any undesired change in the extension thereof. The output of the valve 56 is fed to the oil gallery 50 as shown and therefrom to the variable volume chamber 44 as previously described.

Figure 4:
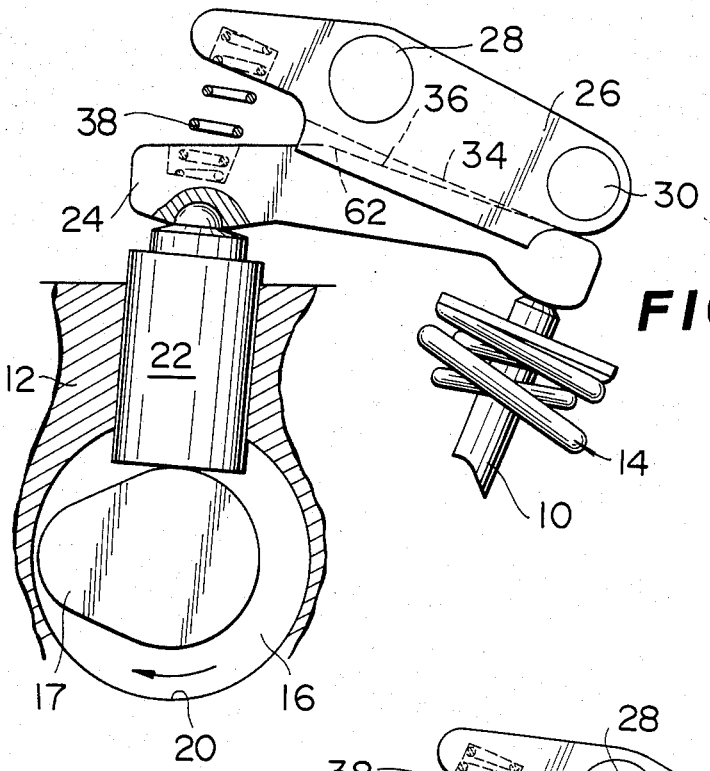
FIGS. 4 and 5 are elevations showing the hydraulic tappet extended to induce maximum valve lift.
Figure 5:
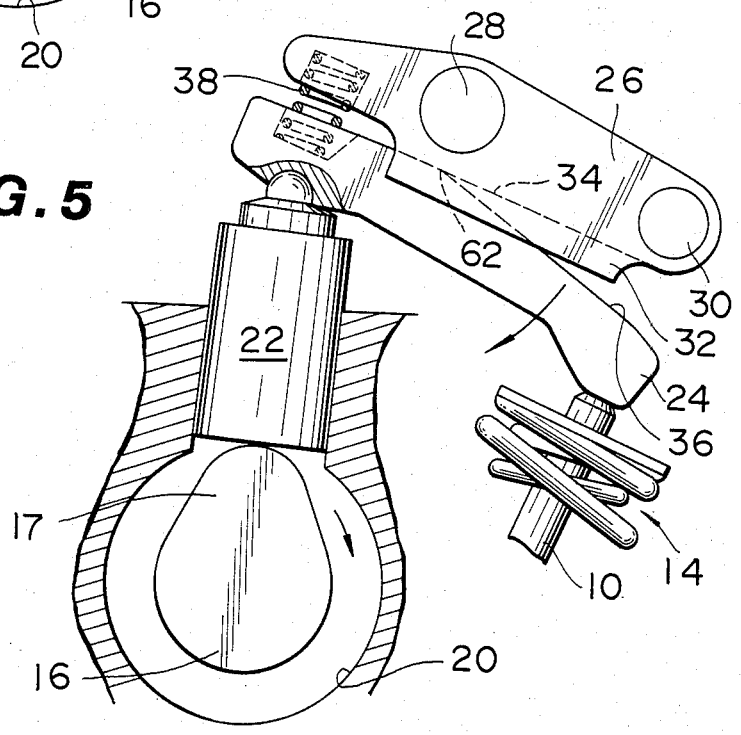

FIGS. 2, 4 and 5 show the hydraulic tappet 22 fully extended for inducing maximum valve lift. In operation, as the cam 16 rotates and the lobe 17 thereof engages the bottom of the cylinder 42, the unit as a whole tends to be driven upwardly. During the initial stage of the lift operation, the spring 38 is firstly compressed and the rocker arm 24 induced to move upwardly until the apex 62 (defined of the elbow of the angled rocker arm) of the arm 24 engages the flat surface 34 formed on the reaction member 26, whereafter the arm 24 pivots and drives the valve 10 down against the bias of the nested springs 14. As the valve 10 is moved against the bias of the springs 14, the piston 40 tends to be driven down slightly into the cylinder 42 by the resulting reaction compressing the fluid trapped in the variable volume chamber 44 until a predetermined pressure is reached whereat the fluid acts as a "quasi" solid body.

It should be noted that during each of the lift operations, some of the fluid trapped in the variable volume chamber 44 tends to escape through the clearances defined between the piston 40 and cylinder 42 and even via the one-way check valve 48, however the amount of oil lost is negligible and immediately replaced at end of each lift operation wherein the bottom of the cylinder 42 rides on the base circle of the cam 16 and the spring 38 urges the piston 40 back to its original position.

Figure 6:
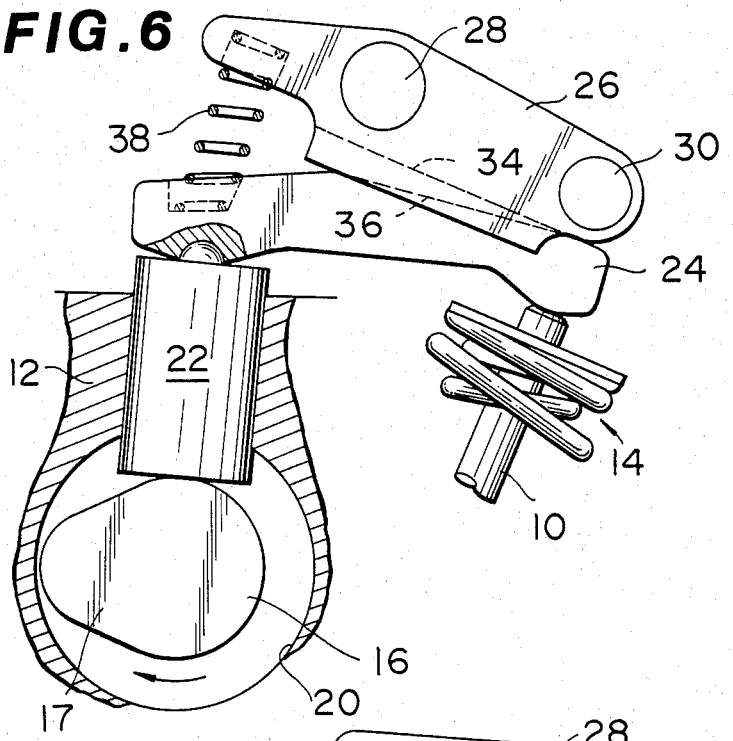
FIGS. 6 and 7 are views similar to FIGS. 4 and 5 but showing the hydraulic tappet set to induce minimum valve lift.
Figure 7:
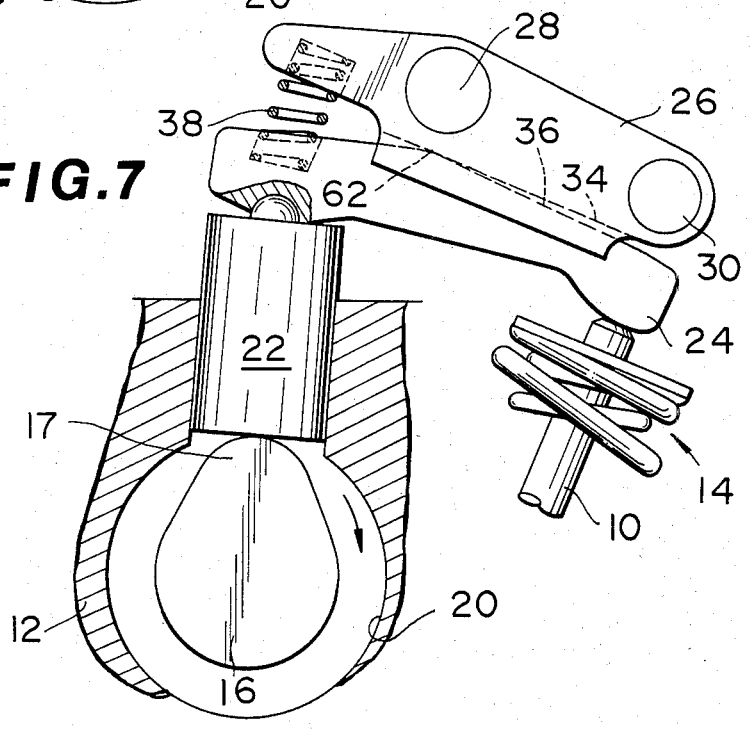

FIGS. 6 and 7 show the tappet 22 with the piston 40 fully retracted into the cylinder 42 for minimum valve lift. To achieve this, the pressure in the oil gallery 50 is reduced via the operation of the electromagnetic valve 56 whereafter the fluid trapped in the variable volume chamber 44 is gradually expelled via the aforementioned clearances until the pressure in the chamber 44 and the fixed volume chamber 46 become equal. With the piston 40 fully retracted, the distance between the apex 62 of the rocker arm 24 and the surface 34 of the reaction mixture 26 tends to maximize (as shown in FIG. 6) so that during the initial stage of the lift operation the rocker arm 24 must be moved through a relatively large distance before engagement of the apex 62 with the surface 34 and subsequent movement of the valve 10. Thus, when the peak of the cam lobe 17 engages the bottom of the cylinder 42, the valve 10 is lifted by only a small amount as compared with the maximum valve lift operation wherein the apex 62 makes contact with the reaction member 26 after moving through only a relatively short distance.

Figure 8:
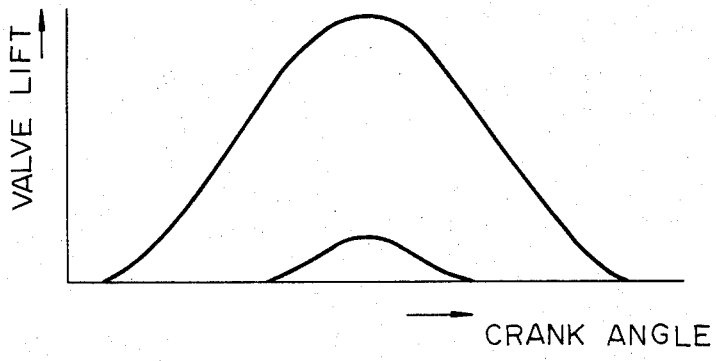
FIG. 8 is a graph showing the terms of valve lift and crank angle, maximum and minimum valve lifts possible with the various embodiments of the present invention.

FIG. 8 is a graph showing possible maximum and minimum valve lifts which may be produced by the embodiments of the present invention. It should be noted however, that it is possible to have a zero valve lift (viz., disable the valve) if so desired. This is of course achieved by increasing the distance defined between the apex of the rocker arm and the reaction member (via appropriately designing the tappet etc.) a little more than shown in FIG. 6.

Figure 9:
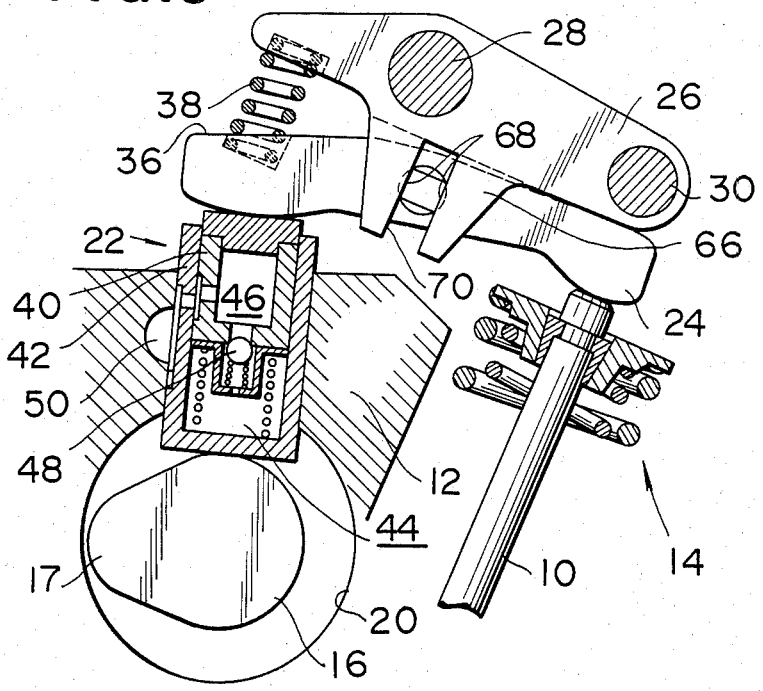
FIG. 9 shows a second embodiment of the present invention wherein the lever and rocker arm are mechanically interconnected to prevent relative slip therebetween during valve lift operation.

FIG. 9 shows a second embodiment of the present invention. This arrangement differs from the previously described arrangement in that the rocker arm 24 and the reaction member 26 are mechanically interconnected to prevent relative slip between the two members during operation. The mechanical connection takes the form of a shaft (not labelled) rotatably disposed through essentially the midpoint of the rocker arm and a pair of forks 66 which extend down from the reaction member on either side of the rocker arm. The rotatable shaft is formed with flats 68 thereon which slide on the opposed walls of the slots 70 defined by the forks 66.

Figure 10A:
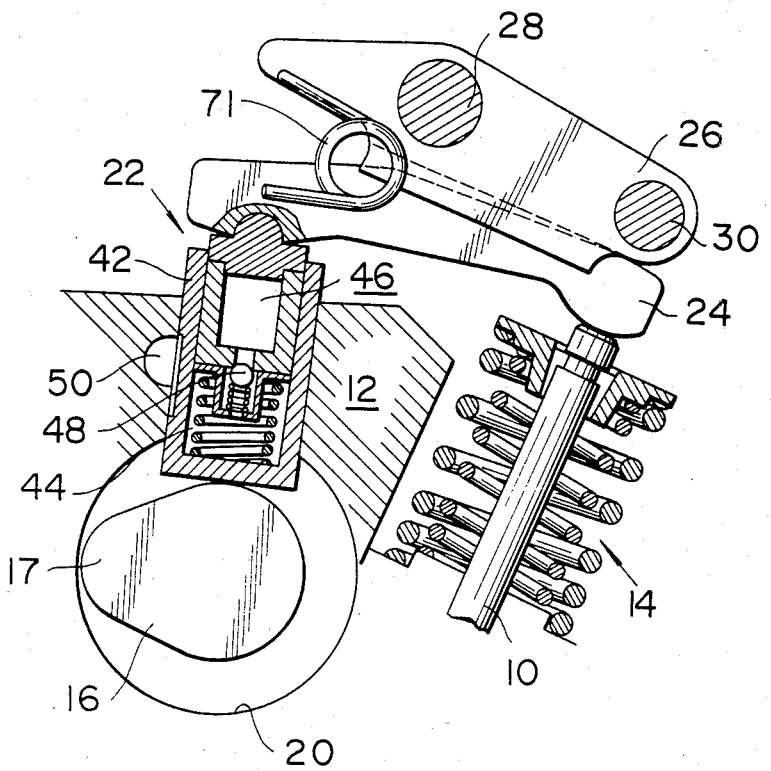
FIGS. 10A and 10B show a third embodiment of the present invention wherein a torsion spring replaces the coil springs of the previous embodiments.
Figure 10B:
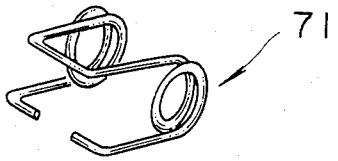

FIGS. 10A and 10B show a third embodiment of the present invention. In this arrangement the coil spring of the previous embodiments is replaced with a single torsion spring 71 (shown in FIG. 10B) which is adapted to seat between and clip onto both of the rocker arm 24 and the reaction member 26.

Figure 11:
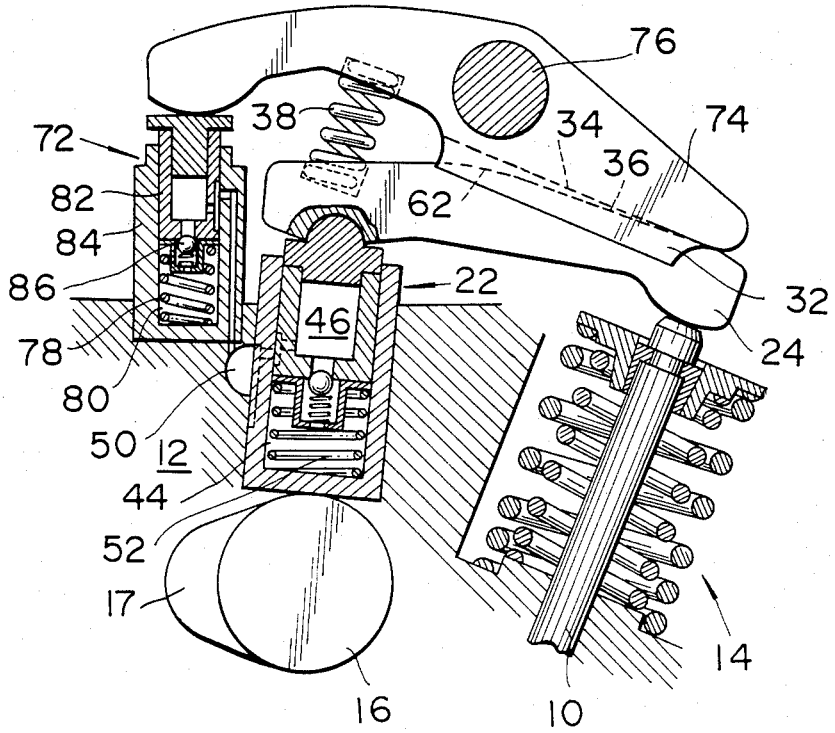
FIG. 11 is a sectional elevation showing a fourth embodiment of the present invention wherein an additional hydraulic cylinder arrangement is provided for maintaining the valve clearance between the rocker arm and the valve stem at zero throughout all modes of operation.

FIG. 11 shows a fourth embodiment of the present invention which resembles the first embodiment but features the provision of a hydraulic cylinder 72 which continuously maintains a zero valve clearance between the rocker arm 24 and the valve stem and a reaction member 74, which in this case is pivotally mounted on a shaft 76 as differentiated from the fixed arrangement of the previous embodiments. The construction of the hydraulic cylinder 72 is essentially the same as that of the tappet 22. The bias applied to the reaction member 74 by the cylinder 72 and which tends to rotate the reaction member 74 in the clockwise direction, is of course notably less that the bias produced by the nested springs 14 so as not to unwantedly open the valve 10 but merely to press the end of the rocker arm 24 in contact with the top of the valve stem, against the stem with a force adequate for reducing the clearance therebetween to zero.

Thus, if due to any one of a number of well known reasons a clearance develops between the rocker arm and the valve stem, the hydraulic cylinder tends to elongate under the influence of the spring 78 disposed therein whereby additional hydraulic fluid is inducted into the variable volume chamber 80 thereof. The reaction member 74 is accordingly rotated slightly to close the clearance. Conversely, if an excessive surface pressure is developed between the stem and the rocker arm, the reaction member 74 tends to rotate in the counter-clockwise direction compressing the hydraulic cylinder 72. Under these conditions fluid is slowly displaced from the variable volume chamber via clearances defined between the piston 82 and cylinder 84 thereof and via a one-way check valve 86 (a hermetic seal not being provided therebetween). Accordingly, the degree of extension of the hydraulic cylinder 72 slowly decreases until the desired zero valve clearance maintaining equilibrium is re-established.

FIGS. 12 and 13 show the operation of the fourth embodiment with the telescopic hydraulic tappet 22 extended to produce maximum valve lift. As apparent from the drawings the operation of this arrangement is essentially the same as the previously disclosed embodiments, however at the time the cam lobe 17 induces the maximum rotation of the rocker arm 24, the apex 62 engages the reaction member at a point which tends to product the minimum moment of force tending to rotate the reaction member 74 about the axis of rotation of the shaft 76 in counter-clockwise direction.

Conversely when the telescopic tappet 22 is set to produce the minimum valve lift as shown in FIGS. 14 and 15, the apex 62 of the rocker arm 24 engages the reaction member 74 a point displaced further from the axis of rotation of the shaft 76. However, as the degree of valve lift is small (or even zero) the reaction produced by the nested springs 14 is relatively small so that the resulting effect on the reaction member is accordingly small.

What is claimed is:

1. In a valve train for inducing reciprocating motion in a valve having a cam mounted on a cam shaft which is driven to continuously rotate, means for controllably varying valve operation of said valve, comprising:

a telescopic hydraulic tappet in following engagement with said cam;

a rocker arm pivotally mounted at one end on said tappet and engaging said valve at the other end thereof;

a reaction member against which said rocker arm is abutable to define a fulcrum, said reaction member immovably mounted with respect to said cam shaft and connected to a bias means for biasing apart the reaction member and the rocker arm; and control means for selectively supplying hydraulic fluid under pressure to said telescopic hydraulic tappet whereby operating characteristics of said valve are varied.

2. In a valve train for inducing reciprocating motion in a valve having a cam mounted on a cam shaft which is driven to continuously rotate, means for controllably varying valve operation of said valve, comprising:

a telescopic hydraulic tappet in following engagement with said cam;

a rocker arm pivotally mounted at one end on said tappet and engaging said valve at the other end thereof;

a reaction member against which said rocker arm is abutable to define a fulcrum, said reaction member connected to a bias means for biasing apart the reaction member and the rocker arm; and control means for selectively supplying hydraulic fluid under pressure to said telescopic hydraulic tappet;

said reaction member having a fork extending therefrom and said rocker arm has a shaft rotatably disposed therethrough at a location intermeditate of the ends thereof, said shaft being slidably received in said fork, whereby operating characteristics of said valve are varied.

3. In a valve train:

a cam mounted on a cam shaft which is driven to continuously rotate;

a telescopic hydraulic tappet in following engagement with said cam;

a rocker arm pivotally mounted at a first end thereof on said hydraulic tappet and engaging said valve at a second end thereof;

an elongated reaction member having first and second ends and overlaying said rocker arm, said reaction member being formed with an elongate slot in which said rocker arm is received;

bias means mounted between the first end of said reaction member and the first end of said rocker arm for biasing the first end of said rocker arm away from the first end of said reaction member and into engagement with said hydraulic tappet;

said rocker arm being shaped so that a fulcrum between said reaction member and said rocker arm is not established until an apex portion formed on said rocker arm is moved, by an action of said cam and hydraulic tappet, into engagement with said reaction member, whereafter said rocker arm pivots to open said valve; and a control device for varying the degree of extension of said hydraulic tappet in a manner to vary the distance through which said apex portion must be moved under the influence of said cam and hydraulic tappet before contacting said reaction member, said reaction member disposed in a spaced contact-free relationship with respect to said tappet and said valve and immovably mounted with respect to said cam shaft, whereby the amount of pivoting of said rocker arm and the valve lift of the valve is controlled by said control device.

4. In a valve train:

a cam mounted on a cam shaft which is driven to continuously rotate;

a telescopic hydraulic tappet in following engagement with said cam;

a rocker arm pivotally mounted at a first end thereof on said hydraulic tappet and engaging said valve at a second end thereof;

an elongate reaction member having first and second ends and overlaying said rocker arm, said reaction member being formed with an elongate slot in which said rocker arm is received;

bias means mounted between the first end of said reaction member and the first end of said rocker arm for biasing the first end of said rocker arm away from the first end of said reaction member and into engagement with said hydraulic tappet;

said rocker arm being shaped so that a fulcrum between said reaction member and said rocker arm is not established until an apex portion formed on said rocker arm is moved, by an action of said cam and hydraulic tappet, into engagement with said reaction member, whereafter said rocker arm pivots to open said valve; and a control device for varying the degree of extension of said hydraulic tappet in a manner to vary the distance through which said apex portion must be moved under the influence of said cam and hydraulic tappet before contacting said reaction member varying timing of the establishment of said fulcrum, whereby the amount of pivoting of said rocker arm and the valve lift of the valve is controlled by said control device.

5. A valve train as claimed in claim 4, wherein said reaction member is disposed in a spaced contact-free relationship with respect to said tappet and said valve and pivotally mountted at a locaton between said first and second ends thereof.

6. A valve train as claimed in claim 5, wherein said reaction member is biased to pivot by an extensible hydraulic cylinder which cooperates with the first end thereof in a manner that said second end of said reaction member presses the second end of said rocker arm against said valve.

7. A valve train having a means for controllably varying valve lift and opening angle comprising:

a cam mounted on a rotatingly driven cam shaft;

a rocker arm having first and second ends, said second end engaging a valve;

first means having first and second ends, said first end thereof engaging said first end of said rocker arm for providing predetermined movement to said rocker arm to open and close said valve and said second end thereof being in a cam following arrangement with said cam;

said first means having first and second controllable relatively displaceable elements providing a controllable initial displacement offset of said rocker arm, thereby to vary valve lift and timing for the valve in response to rotation of said cam;

a reaction means contacting said rocker arm in opposing relationship from said first means;

said rocker arm and said reaction means having cooperating surfaces shaped to provide a fulcrum for rotation of said rocker arm thereabout after a specified movement of said rocker arm by said first means whereby operating characteristics of said valve are varied by varying timing of the establishment of said fulcrum.

8. A valve train as recited in claim 7, wherein said first means comprises controllable telescoping hydraulic tappet means having a first element which includes said first end of said first means engaging said rocker arm, a second element driven by said cam and including said second end of said first means, and hydraulically driven means for controllably displacing said first and second elements from one another to vary said initial offset of said rocker arm, whereby controllably differing amounts of displacement of said tappet by said cam are required to provide, in combination with said offset, the predetermined movement of said rocker necessary to open and close said valve.

9. A valve train as recited in claim 8 further comprising biasing means mounted between a first end of said reaction means and said first end of said rocker arm for biasing the first end of said rocker arm away from said first end of said reaction means and towards engagement with said hydraulic tappet means.

10. A valve train as recited in claim 9 wherein said rocker arm surface engaging said reaction means is formed with an apex for forming said fulcrum, said biasing means, said reaction means and said rocker arm being arranged so that said fulcrum is not established until said apex is moved by action of said cam and said hydraulic tappet means into engagement with said reaction means.

11. A valve train as recited in claim 10 further comprising control means for varying the relative displacement between said first and second elements of said hydraulic tappet means to vary said offset displacement of said rocker arm, thereby to vary the valve lift and timing of said valve.

12. In a valve train for inducing reciprocating motion in a valve having a cam mounted on a cam shaft which is driven to continuously rotate, means for controllably varying valve operation of said valve, comprising:

a telescopic hydraulic tappet in following engagement with said cam;

a rocker arm pivotally mounted at one end on said tappet and engaging said valve at the other end thereof;

a reaction member against which said rocker arm is abutable to establish a fulcrum after a specified movement of said rocker arm by said hydraulic tappet, said reaction member connected to a bias means for biasing apart the reaction member and the rocker arm; and control means for selectively supplying hydraulic fluid under pressure to said telescopic hydraulic tappet whereby operating characteristics of said valve are varied varying timing of the establishment of said fulcrum.

13. A valve train as claimed in claim 12 wherein said reaction member is pivotally mounted on a shaft and includes a hydraulic cylinder cooperating with one end thereof, said hydraulic cylinder being communicated with and responsive to said control means and adaptted to apply a bias to said reaction member, said bias tending to rotate said reaction member in one rotational direction, whereby clearance between said rocker arm and said valve is adjusted.

14. A valve train as claimed in claim 12, wherein said rocker arm is angled to define an apex which engages said reaction member after said telescopic hydraulic tappet and said cam have moved said rocker arm against the bias of said spring toward said reaction member through a distance which varies with the degree of extension of said telescopic hydraulic tappet whereafter said rocker arm pivots.

15. A valve train as claimed in claim 12, wherein said reaction member is formed with an elongate slot in which said rocker arm is received.

16. A valve train as claimed in claim 12, wherein said reaction member is disposed in a spaced contact-free relationship with said hydraulic tappet and said valve.

17. A valve train as claimed in claim 12, wherein said bias means comprises a spring.

18. A valve train as claimed in claim 17, wherein said spring is a coil spring.

19. A valve train as claimed in claim 17, wherein said spring is a torsion spring.

* * * * *